US006682342B2

(12) United States Patent
Takemura et al.

(10) Patent No.: US 6,682,342 B2
(45) Date of Patent: Jan. 27, 2004

(54) COMBUSTOR FOR WASTE GAS TREATMENT

(75) Inventors: Yoshiro Takemura, Kanagawa (JP); Kohtaro Kawamura, Tokyo (JP); Yuji Shirao, Kanagawa (JP); Rikiya Nakamura, Kanagawa (JP)

(73) Assignee: Ebara Corporation, Tokyo (JP)

( * ) Notice: Subject to any disclaimer, the term of this patent is extended or adjusted under 35 U.S.C. 154(b) by 1 day.

(21) Appl. No.: 10/284,236

(22) Filed: Oct. 31, 2002

(65) Prior Publication Data

US 2003/0054314 A1 Mar. 20, 2003

Related U.S. Application Data

(62) Division of application No. 09/509,995, filed as application No. PCT/JP98/05196 on Nov. 19, 1998, now Pat. No. 6,494,711.

(30) Foreign Application Priority Data

Nov. 21, 1997 (JP) ..... 09-338034
Nov. 6, 1998 (JP) ..... 10-316521

(51) Int. Cl.[7] ..... F23G 7/06; F23D 14/10

(52) U.S. Cl. ..... 431/353; 239/400; 239/424.5; 239/434; 239/428

(58) Field of Search ..... 431/353, 5, 185, 431/202; 110/213, 214; 239/422, 424, 424.5, 425, 426, 428, 434, 400, 405, 549; 422/182, 183

(56) References Cited

U.S. PATENT DOCUMENTS

| | | | |
|---|---|---|---|
| 1,656,907 | A | 1/1928 | Bansen |
| 3,577,728 | A | 5/1971 | Von Brimer et al. |
| 3,898,317 | A | 8/1975 | Hemsath et al. |
| 4,154,567 | A | 5/1979 | Dahmen |
| 4,483,832 | A | 11/1984 | Schirmer |
| 4,661,056 | A | 4/1987 | Vickery et al. |
| 4,801,437 | A | 1/1989 | Konagaya et al. |
| 4,913,069 | A | 4/1990 | Schultz et al. |
| 5,009,174 | A | 4/1991 | Polak |
| 5,236,350 | A | 8/1993 | Cummings, III et al. |
| 5,510,093 | A | 4/1996 | Bartz et al. |
| 5,603,905 | A | 2/1997 | Bartz et al. |

FOREIGN PATENT DOCUMENTS

| | | | |
|---|---|---|---|
| EP | 076020 | A2 * | 4/1983 |
| EP | 1193443 | A2 * | 4/2002 |
| EP | 1227275 | A1 * | 7/2002 |
| JP | 58-2519 | | 1/1983 |
| JP | 58-108322 | | 6/1983 |
| JP | 59-15718 | A | 1/1984 |
| JP | 9-42643 | | 2/1997 |
| JP | 11-153303 | A * | 6/1999 |

OTHER PUBLICATIONS

Patent Abstracts of Japan, vol. 008, No. 104 (M–296), May 16, 1984 & JP 59 015718 A (Kiyoshi Okonogi; Others: 01), Jan. 26, 1984.

Microfilm of the specification and drawings annexed to the request of Japanese Utility Model Application No. 59726/1979 (Laid–open No. 158436/1980) (Osaka Gas Co., Ltd.), Nov. 14, 1980, p. 2, line 20 to p. 4, line 15 (Family: none).

* cited by examiner

*Primary Examiner*—Sara Clarke
(74) *Attorney, Agent, or Firm*—Wenderoth, Lind & Ponack, L.L.P.

(57) ABSTRACT

A combustor for waste gas treatment having a flame stabilizing zone 15 surrounded by a peripheral wall 13 and closed with a bottom wall 14. The flame stabilizing zone 15 is provided to face a combustion chamber 11. Burner ports 23 for auxiliary combustible gas are provided in the peripheral wall 13 to inject an auxiliary combustible gas B into the flame stabilizing zone 15 so as to produce swirling flows. Burner ports 22 for waste gas are provided in the bottom wall 14 to inject a waste gas A into the flame stabilizing zone 15.

8 Claims, 12 Drawing Sheets

COMBUSTOR FOR WASTE GAS TREATMENT

This is a divisional of application Ser. No. 09/509,995, filed Apr. 5, 2000, now U.S. Pat. No. 6,494,711, which is a national stage application of international application number PCT/JP98/05196 filed on Nov. 19, 1998.

TECHNICAL FIELD

The present invention relates to a combustor (burner) for waste gas treatment usable in combustion type waste gas treatment facilities for combustion-treating a harmful and combustible waste gas containing, for example, silane gas ($SiH_4$) or a halogen gas ($NF_3$, $ClF_3$, $SF_6$, $CHF_3$, $C_2F_6$, $CF_4$, etc.).

BACKGROUND ART

For example, a semiconductor manufacturing system discharges a gas containing harmful and combustible gases, e.g. silane ($SiH_4$) and disilane ($Si_2H_6$). Such a waste gas cannot be emitted into the atmosphere as it is. Therefore, the common practice is to introduce such a waste gas into a pretreatment system where it is made harmless by oxidation through combustion. For this treatment, a method wherein flames are formed in a furnace by using an auxiliary combustible gas and the waste gas is burned with the flames is widely used.

Such combustion type waste gas treatment system usually uses an auxiliary combustible gas consisting essentially of a fuel gas, e.g. hydrogen, city gas, or LPG, and an oxidizing agent, e.g. oxygen or air. The greater part of the running cost of the system is the cost for consumption of the fuel gas and the oxidizing agent. Accordingly, how much harmful waste gas can be destroyed efficiently with a minimum amount of auxiliary combustible gas is a measure of evaluating the performance of this type of system.

When silane, for example, is oxidized, silica ($SiO_2$) is formed. Silica ($SiO_2$) is a powdery substance, which may adhere to the wall surface of the combustion chamber and the burner ports, inducing poor combustion or causing clogging of the combustion chamber. Therefore, it is necessary to periodically carry out a cleaning operation to remove silica ($SiO_2$). The cleaning is performed by a manual operation in the state of the art. Accordingly, the longer the cleaning operation interval, the easier the maintenance. The cleaning operation interval is also considered to be one of the important factors in evaluating the performance of a combustion type waste gas treatment system.

A general arrangement of a combustor used in a conventional combustion type waste gas treatment system as stated above is shown in FIGS. 23 and 24. A cylindrical combustion chamber 1 has a waste gas nozzle 2 provided in the center of the ceiling thereof to introduce a waste gas A to be treated into the combustion chamber 1. A plurality of auxiliary combustible gas nozzles 3 are provided around the outer periphery of the waste gas nozzle 2 to introduce an auxiliary combustible gas B into the combustion chamber 1. A combustion gas outlet 4 is integrally connected to the lower end of the combustion chamber 1. Thus, the waste gas A is passed through the center of flames formed in a side-by-side relation along a circle by the auxiliary combustible gas B injected from the auxiliary combustible gas nozzles 3. After it has passed, the waste gas A is mixed with the flames to burn. The resulting combustion gas is discharged to the outside from the combustion gas outlet 4.

At present, heat destruction is considered to be the most widely used method of destruction-treating a halogen gas, which is considered to be a main cause of global warming. That is, the destruction of a halogen gas needs high-temperature conditions created by a huge amount of heat or requires an enormous amount of excitation energy produced by plasma or the like. Using such a technique, destruction treatment of a halogen gas is carried out in destruction treatment equipment having a heating device, e.g. a heater, or a plasma generator and a complicated control mechanism, e.g. a safety device.

In the above-described conventional system, however, the flames of the auxiliary combustible gas are formed forward of the auxiliary combustible gas nozzles. Accordingly, the waste gas being injected forward from the waste gas nozzle, which is provided inside the auxiliary combustible gas nozzles, cannot always sufficiently mix with the flames of the auxiliary combustible gas. Therefore, the efficiency of destruction of the waste gas is not satisfactorily high. It is necessary, in order to increase the efficiency of destruction, to increase the amount of auxiliary combustible gas supplied so as to form large flames, thereby allowing the waste gas to burn easily. However, if the amount of auxiliary combustible gas supplied is increased, the amount of auxiliary combustible gas that does not contribute to the destruction of the waste gas also increases, causing an increase in running cost of the system. Moreover, silica ($SiO_2$) resulting from the combustion of the waste gas undesirably adheres to the wall surface of the combustion chamber. Thus, depending on circumstances, the cleaning operation needs to be performed once or twice a week. In addition, destruction treatment of a halogen gas requires complicated equipment.

It should be noted that various techniques have been proposed to solve the above-described problems. For example, flames that are produced in side-by-side relation along a circle are so formed that the distal end of each flame slants toward the center of the circle, thereby allowing the waste gas to be efficiently exposed to the high-temperature portion of each individual flame. According to another technique, flame pipes are provided to maintain flames for an increased period of time, thereby allowing the flames and the waste gas to contact each other efficiently. However, it is deemed that these techniques have not completely solved the above-described problems. There has also been proposed a method of destruction-treating a halogen gas by using a combustor. With this method, however, the efficiency of destruction may vary to a considerable extent according to the rate of combustion. Therefore, the proposed method has not completely solved the above-described problems.

In view of the above-described circumstances, an object of the present invention is to provide a combustor for waste gas treatment usable in a combustion type waste gas treatment system, which provides a high efficiency of destruction of waste gas and yet allows the maintenance interval for cleaning to be lengthened and which is capable of destruction-treating a halogen gas with high efficiency.

SUMMARY OF INVENTION

According to a first aspect of the present invention, there is provided a combustor for waste gas treatment characterized by having a flame stabilizing zone surrounded by a peripheral wall and closed with a bottom wall. The flame stabilizing zone is provided to face a combustion chamber. A burner port for auxiliary combustible gas is provided in the peripheral wall to inject an auxiliary combustible gas into the flame stabilizing zone so as to produce a swirling flow. A burner port for waste gas is provided in the bottom wall to inject a waste gas into the flame stabilizing zone.

Thus, the auxiliary combustible gas is injected into the flame stabilizing zone so as to produce a swirling flow, thereby efficiently mixing the flame of the auxiliary combustible gas with the waste gas to be treated, and thus allowing the waste gas to be destroyed through combustion with high efficiency. Moreover, silica ($SiO_2$) resulting from the combustion of silane gas or the combustion chamber by the swirling flame and the swirling flow. Thus, the waste gas can be stably treated through combustion for a long period of time.

In the case of a cylindrical combustion chamber, the peripheral wall can be formed by the inner peripheral surface of a cylindrical member.

It is preferable that a wall surface forming the combustion chamber be provided with an air injection nozzle for injecting air into the combustion chamber. Thus, the gas subjected to the combustion treatment is cooled with the air injected from the air injection nozzle. Moreover, the cooled combustion gas can be rapidly discharged out of the combustion chamber.

It is preferable that the air injection nozzle be provided so that air injected from the air injection nozzle forms a swirling flow in the combustion chamber. Thus, it is possible to cool the gas subjected to the combustion treatment, discharge the cooled gas out of the combustion chamber and remove silica ($SiO_2$) from the wall surface of the combustion chamber even more effectively.

Further, it is preferable that the bottom wall be provided with a primary air injection nozzle for injecting primary air into the flame stabilizing zone. Thus, combustibility can be improved, and silica ($SiO_2$) adhered to the surfaces of the inner and outer walls defining the flame stabilizing zone can be removed even more effectively.

It is preferable that the inner diameter of the combustion chamber and the inner diameter of the peripheral wall of the flame stabilizing zone be approximately identical with each other. Thus, a stagnant flow region is eliminated, and it is possible to prevent powdery silica ($SiO_2$) from adhering to the inner wall of the flame stabilizing zone or the combustion chamber even more effectively.

An air nozzle for secondary combustion may be provided in the peripheral wall of the flame stabilizing zone downstream of the burner port for auxiliary combustible gas, whereby a reducing flame of primary combustion and an oxidizing flame of secondary combustion by the air are formed in the flame stabilizing zone, thereby making it possible to improve the efficiency of destruction of the waste gas, particularly a halogen gas.

According to a second aspect of the present invention, there is provided a combustor for waste gas treatment characterized by having a flame stabilizing zone surrounded by a peripheral wall and closed with a bottom wall. The flame stabilizing zone is provided to face a combustion chamber. A burner port for waste gas is provided in the bottom wall to inject a waste gas into the flame stabilizing zone. An air injection nozzle is provided in the peripheral wall of the flame stabilizing zone near the bottom wall to inject air so as to produce a swirling flow. A burner port for auxiliary combustible gas is provided in the peripheral wall of the flame stabilizing zone away from the bottom wall to inject an auxiliary combustible gas, such as a fuel gas or a premixed gas, into the flame stabilizing zone so as to produce a swirling flow.

Thus, an air flow is injected from the air injection nozzle provided in the peripheral wall of the flame stabilizing zone near the bottom wall so as to form a swirling flow. Therefore, the peripheral wall of the flame stabilizing zone can be cooled. Accordingly, the auxiliary combustible gas injecting from the burner port for auxiliary combustible gas, which is away from the bottom wall, is cooled, and thus stable combustion can be continued. Further, the swirling flow of flame is accelerated, so that it is possible to prevent silica ($SiO_2$) resulting from the combustion of silane ($SiH_4$) from adhering to the peripheral wall of the flame stabilizing zone or the combustion chamber even more effectively.

It is preferable that the auxiliary combustible gas be an over-rich premixed gas containing a fuel gas in excess of a stoichiometric amount. Thus, it is possible to form different flames, i.e. oxidizing flame and reducing flame, and hence possible to increase the efficiency of destruction of a halogen gas.

It is preferable that a secondary combustion air injection nozzle be provided in a wall surface extending from the peripheral wall of the flame stabilizing zone to form the combustion chamber or in a peripheral wall surface near the lower end of the flame stabilizing zone. Thus, the high-temperature region can be enlarged downward, and the efficiency of destruction of a halogen gas can be increased.

It is preferable that the inner diameter of the combustion chamber and the inner diameter of the peripheral wall of the flame stabilizing zone be approximately identical with each other. Thus, a stagnant flow region is eliminated, and it is possible to prevent powdery silica ($SiO_2$) from adhering to the inner wall of the flame stabilizing zone or the combustion chamber even more effectively.

It is preferable that the burner port for auxiliary combustible gas be provided to face obliquely downward. Thus, it is possible to suppress heating of the cylindrical member and the rise in temperature and hence possible to extend the heat resistant life. In addition, it is possible to maintain the high-temperature state of the gas and to increase the efficiency of destruction of a halogen gas.

DETAILED DESCRIPTION OF THE INVENTION

Embodiments of the present invention will be described below with reference to FIGS. 1 to 22.

Figure 1:
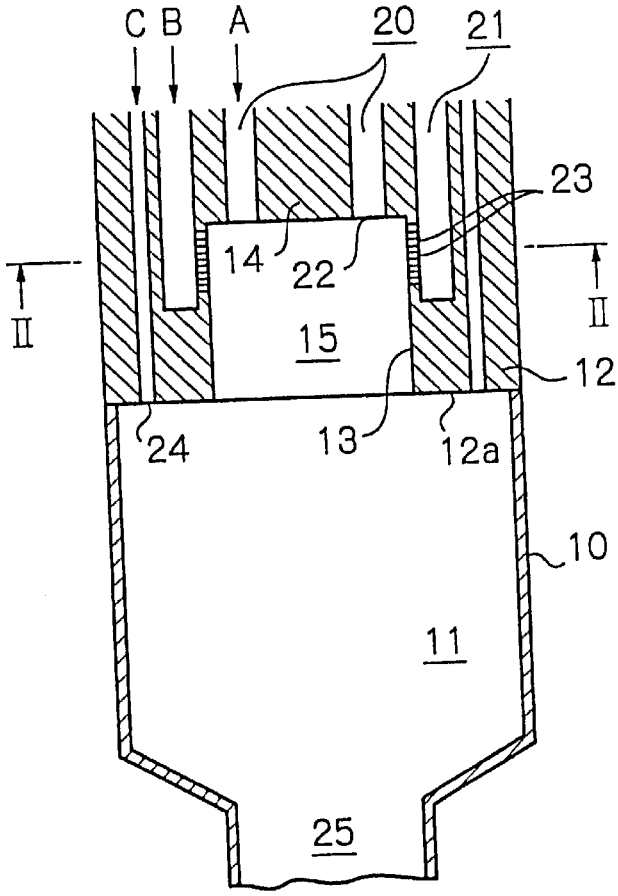
FIG. 1 is a vertical sectional view showing a first embodiment of the present invention.
Figure 2:
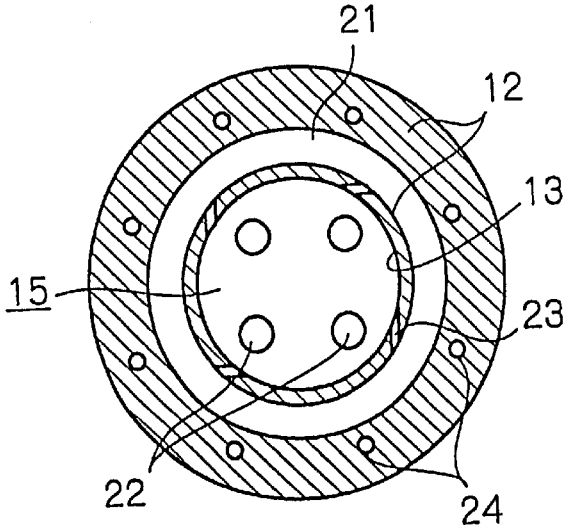
FIG. 2 is a sectional view taken along the line II—II in FIG. 1.

FIGS. 1 and 2 show a first embodiment of the present invention. A flame stabilizing zone 15 faces a combustion chamber 11 surrounded by a furnace wall 10. The flame stabilizing zone 15 is surrounded with a peripheral wall 13 formed by the inner peripheral surface of a cylindrical member 12. The flame stabilizing zone 15 is closed with a bottom wall 14. The cylindrical member 12 is integrally formed with the bottom wall 14.

A plurality (four in the illustrated example) of waste gas chambers 20 are provided in the bottom wall 14 to hold and introduce a waste gas A to be treated, e.g. a waste gas from a semiconductor manufacturing system containing silane ($SiH_4$) or the like and consisting mainly of nitrogen. An auxiliary combustible gas chamber 21 is provided in the bottom wall 14. The auxiliary combustible gas chamber 21 holds and introduces an auxiliary combustible gas B, e.g. a premixed gas of hydrogen and oxygen.

The lower surface of the bottom wall 14 is provided with a plurality of burner ports 22 for waste gas that extend from the respective waste gas chambers 20 and open into the flame stabilizing zone 15. The inner peripheral surface of the cylindrical member 12 is provided with a plurality of burner ports 23 for auxiliary combustible gas that provide communication between the auxiliary combustible gas chamber 21 and the flame stabilizing zone 15. The burner ports 23 for auxiliary combustible gas extend approximately tangentially to the flame stabilizing zone 15 to inject the auxiliary combustible gas B into the flame stabilizing zone 15 so as to form swirling flows.

Further, a plurality of air injection nozzles 24 are provided in an end surface 12*a* of the cylindrical member 12, which connects the cylindrical member 12 and the side surface of the combustion chamber 11 and constitutes a part of the combustion chamber 11. The air injection nozzles 24 inject air C into the combustion chamber 11. In addition, a combustion gas outlet 25 is integrally connected to the lower end of the combustion chamber 11.

Next, the operation of this embodiment will be described.

First, the auxiliary combustible gas B is introduced into the auxiliary combustible gas chamber 21 and held therein and is then injected from the burner ports 23 for auxiliary combustible gas, which are provided in the inner peripheral surface of the cylindrical member 12, into the flame stabilizing zone 15 so as to produce swirling flows. When ignited by an ignition source (not shown), the auxiliary combustible gas B forms swirling flames along the inner peripheral surface of the cylindrical member 12.

As stated above, the auxiliary combustible gas B forms swirling flames. Swirling flames have the feature that they can burn stably even with a small equivalence ratio. In other words, because the flames swirl strongly, they supply heat and radicals to each other. In addition, because the flames are formed along the inner peripheral surface of the cylindrical member 12, the wall surface thereof is heated, and the unburnt auxiliary combustible gas B, e.g. premixed gas, is heated by the heated wall surface. Consequently, flame stabilizing properties are improved. Even at such a small equivalence ratio that unburned gas may be discharged or quenching may occur in the conventional system, the auxiliary combustible gas B can burn stably without generating unburnt gas and without causing oscillating combustion.

Meanwhile, the waste gas A to be treated, which is introduced and held in the waste gas chambers 20, is injected into the flame stabilizing zone 15 from the burner ports 22 for waste gas, which open on the lower surface of the bottom wall 14. Consequently, the waste gas A mixes with the swirling flames of the auxiliary combustible gas B and burns. At this time, because the auxiliary combustible gas B is injected so as to swirl strongly in one direction, the flames of the auxiliary combustible gas B and the waste gas A mix with each other favorably and effectively. Accordingly, all the waste gas A injected mixes with the flames and burns. Thus, the efficiency of the combustive destruction of the waste gas becomes very high.

Air that is injected into the combustion chamber 11 from the air injection nozzles 24 acts as follows. Combustion gas after the combustion treatment has a high temperature and is therefore necessary to cool. Moreover, the combustion gas needs to be rapidly discharged to the outside of the combustion chamber 11. In this regard, the air injected into the combustion chamber 11 from the air injection nozzles 24 is mixed with the high-temperature swirling gas subjected to the combustion treatment and cools the gas. The waste gas increased in the flow rate by the mixing can be smoothly and rapidly discharged from the combustion chamber 11 through the combustion gas outlet 25.

If a premixed gas is used as the auxiliary combustible gas B and the equivalence ratio of the auxiliary combustible gas B is reduced, low-$NO_x$ combustion can be realized. In addition, when swirling flames are formed, the pressure of the gas flow in the center of the swirl reduces. Consequently, self-circulating flows that flow backward from the forward ends of the flames toward the burner ports 22 for waste gas and the burner ports 23 for auxiliary combustible gas occur in the center of the swirl. The circulating flows mix with the flames from the burner ports and the combustion gas, thereby improving low-$NO_x$ combustion performance.

Moreover, the swirling flames from the burner ports 23 for auxiliary combustible gas prevent silica ($SiO_2$), which results from the combustion of silane gas or the like, from adhering to the burner ports 22 for waste gas or the burner ports 23 for auxiliary combustible gas. More specifically, when silane ($SiH_4$) or the like burns, powdery silica ($SiO_2$)

is formed. If the silica ($SiO_2$) adheres to the vicinities of the burner ports 22 for waste gas and the burner ports 23 for auxiliary combustible gas, it may reduce the amounts of auxiliary combustible gas B and waste-gas A being injected or change the directions of these gases being injected, causing the injecting of the gases to be unstable. Under such circumstances, the injecting of the gases is not stabilized, and it becomes impossible to perform stable combustion.

In this embodiment, however, swirling flames formed by the burner ports 23 for auxiliary combustible gas cause fast flows to occur at the distal ends of the burner ports 22 for waste gas and the burner ports 23 for auxiliary combustible gas. The fast flows act so as to clean the distal end portions of the burner ports 22 and 23, thereby preventing the resulting powdery silica ($SiO_2$) from adhering to the distal end portions of the burner ports 22 and 23.

The cleaning effect is not confined to the distal end portions of the burner ports 22 and 23. That is, because the flames swirl in the combustion chamber 11, fast flows also occur along the wall surface of the combustion chamber 11. The fast flows clean the wall surface of the combustion chamber 11, thereby removing silica ($SiO_2$) or the like from the wall surface.

Thus, silica ($SiO_2$) or the like attached to the surfaces of the burner ports 22 and 23 and the wall surface of the combustion chamber 11 is removed in a self-cleaning manner by the swirling flows. Accordingly, it is possible to lengthen the manual cleaning operation interval to a considerable extent and hence possible to facilitate maintenance.

Although in this embodiment the present invention is applied to a cylindrical combustor, it should be noted that the present invention is not necessarily limited thereto but may also be applied to a polygonal combustor, e.g. a quadrangular combustor. The same shall apply in each of the following embodiments.

Figure 3:
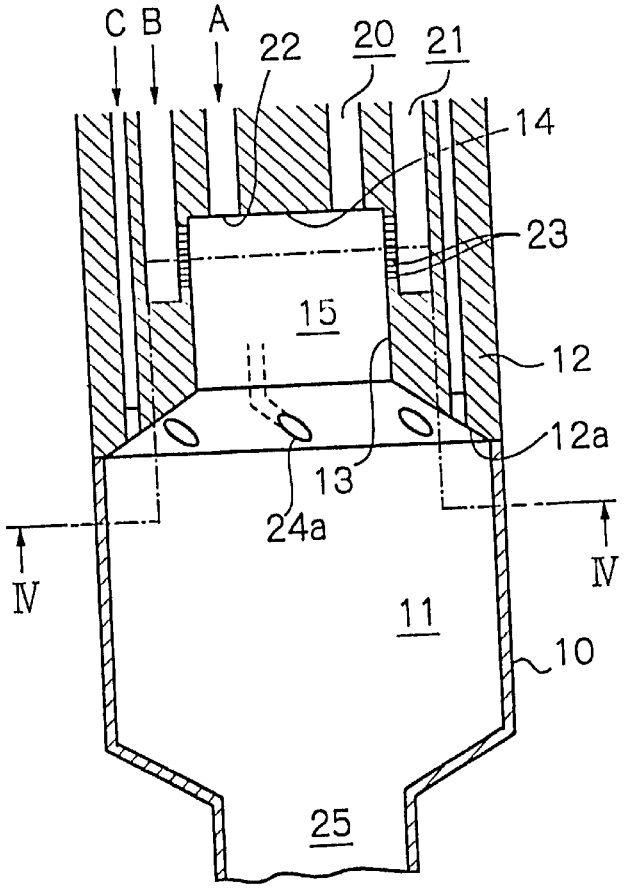
FIG. 3 is a vertical sectional view showing a second embodiment of the present invention.
Figure 4:
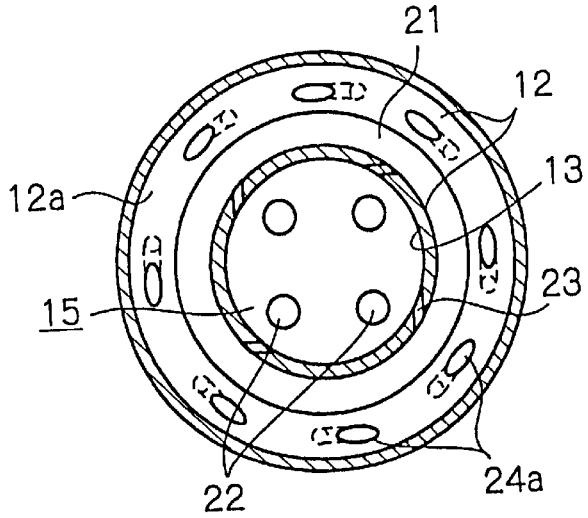
FIG. 4 is a sectional view taken along the line IV—IV in FIG. 3.

FIGS. 3 and 4 show a second embodiment of the present invention. In this embodiment, the cylindrical member 12, which constitutes the peripheral wall 13, has a conical surface as an end surface 12*a* that constitutes a part of the combustion chamber 11. The end surface 12*a* is provided with air injection nozzles 24*a* so that air C injected into the combustion chamber 11 from the air injection nozzles 24*a* produces swirling flows.

In this embodiment, swirling flows are produced in the combustion chamber 11 by air C injected from the air injection nozzles 24*a*, thereby vigorously producing swirling flows in the combustion chamber 11 without weakening the swirling flows from the burner ports 23 for auxiliary combustible gas. Thus, silica attached to the side wall of the combustion chamber 11 can be removed even more effectively.

Figure 5:
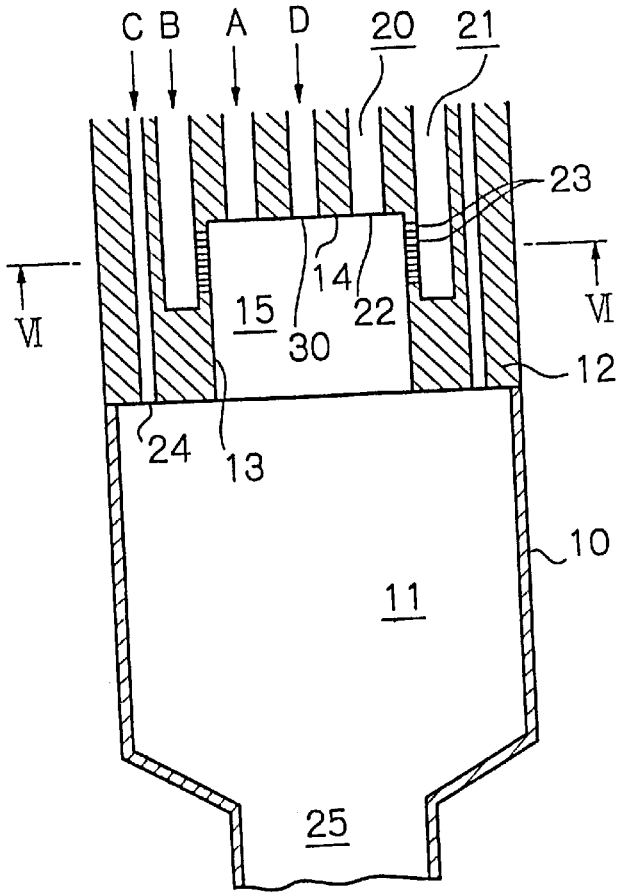
FIG. 5 is a vertical sectional view showing a third embodiment of the present invention.
Figure 6:
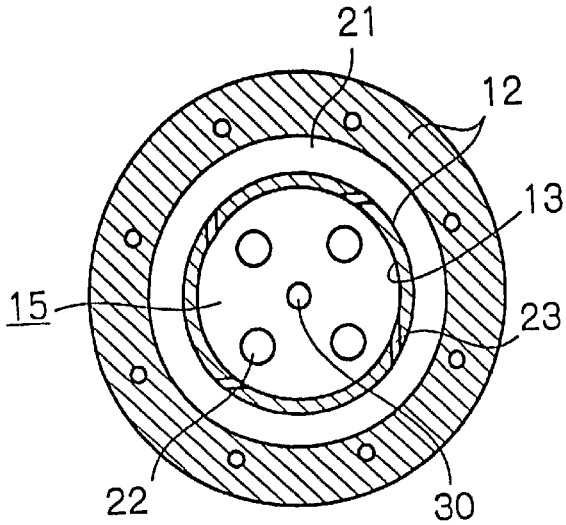
FIG. 6 is a sectional view taken along the line VI—VI in FIG. 5.

FIGS. 5 and 6 show a third embodiment of the present invention. In this embodiment, a primary air injection nozzle 30 is provided in the center of the bottom wall 14. The primary air injection nozzle 30 extends through the bottom wall 14 and opens into the flame stabilizing zone 15 to inject primary air D.

In this embodiment, primary air is supplied into the flame stabilizing zone 15 from the primary air injection nozzle 30 to increase the oxygen density according to need, thereby allowing combustibility to be improved. Moreover, by injecting primary air D downward, a downward velocity is added to the swirling flows in the flame stabilizing zone 15, thereby increasing the velocity of the flows along the surface of the cylindrical member 12. Thus, silica attached to the surface of the cylindrical member 12 can be removed even more effectively.

Figure 7:
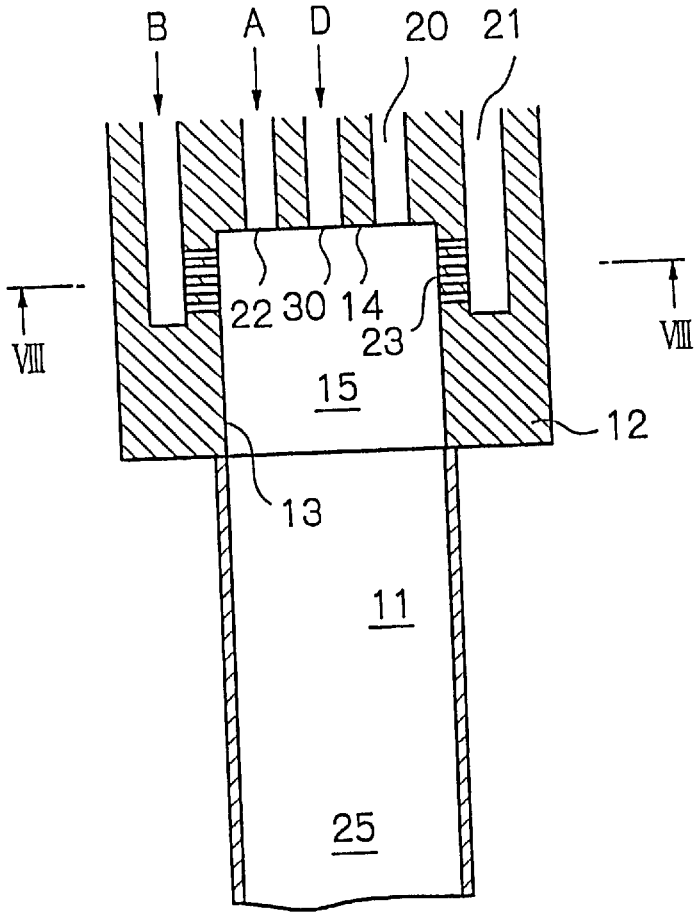
FIG. 7 is a vertical sectional view showing a fourth embodiment of the present invention.
Figure 8:
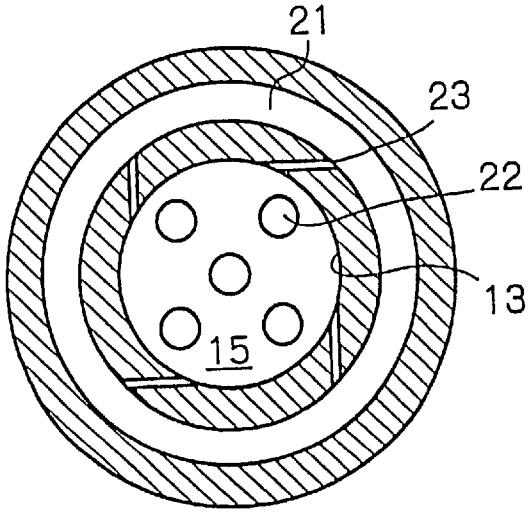
FIG. 8 is a sectional view taken along the line VIII—VIII in FIG. 7.

FIGS. 7 and 8 show a fourth embodiment of the present invention. In this embodiment, the inner diameter of the cylindrical member 12 and the inner diameter of the combustion chamber 11 are set approximately the same. With this arrangement, the swirl diameter of the swirling flows is kept approximately the same all the way to the outlet. Accordingly, favorable swirling flows can be maintained from the flame stabilizing zone to the outlet, and the stagnant flow region can be eliminated. Thus, the amount of powdery silica ($SiO_2$) adhering to the wall surface can be reduced by a considerable extent.

It should be noted that in each of the foregoing embodiments ceramics and heat-resistant metal materials are suitable for use as materials for forming a burner for combustion. Although an example in which the present invention is applied to flames being injected downward is shown in each embodiment, the present invention may also be applied to flames being injected horizontally. The auxiliary combustible gas is not necessarily limited to a premixed gas of hydrogen and oxygen but may be a premixed gas prepared by mixing together city gas or LPG and oxygen, air or oxygen enrichment air.

Figure 9:
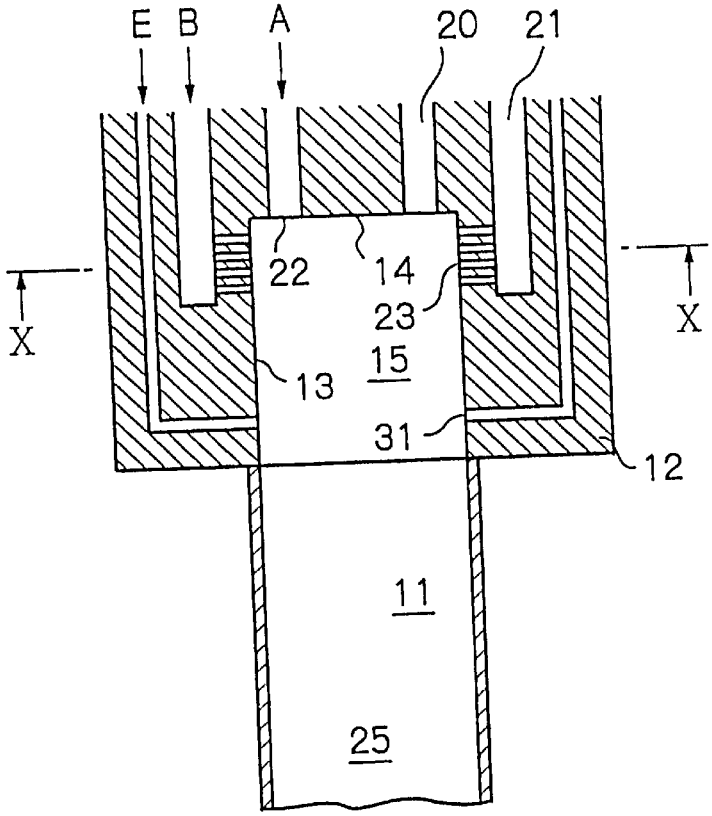
FIG. 9 is a vertical sectional view showing a fifth embodiment of the present invention.
Figure 10:
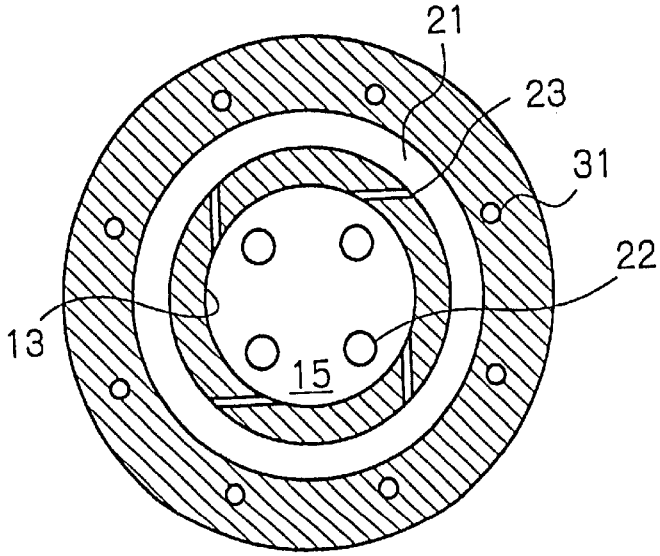
FIG. 10 is a sectional view taken along the line X—X in FIG. 9.

FIGS. 9 and 10 show a fifth embodiment of the present invention. In this embodiment, the inner diameter of the cylindrical member 12 and the inner diameter of the combustion chamber 11 are set approximately the same as in the case of the fourth embodiment, the secondary air injection nozzles 31 for injecting secondary air E are provided in the peripheral wall of the flame stabilizing zone downstream of the burner ports for auxiliary combustible gas. The auxiliary combustible gas B is an over-rich premixed gas that is over-rich in fuel. The auxiliary combustible gas B is injected to swirl from the burner ports 23, thereby forming reducing flames swirling in the flame stabilizing zone. The reducing flames and the waste gas A from the nozzles 22 are brought into contact with each other to reductively destroy the waste gas, particularly a halogen gas. Further, the destroyed waste gas is given a sufficient amount of oxygen from the air injected from the secondary air injection nozzles 31, which are provided downstream of the burner ports 23, to create an excess oxygen condition, thereby forming oxidizing flames. Oxidative destruction of the waste gas is effected completely by the oxidizing flames. Oxidative destruction of the waste gas is effected completely by the oxidizing flames.

More specifically, the mixture ratio of the oxidizing agent to the fuel gas is the premixed gas as an auxiliary combustible gas to be supplied made lower than the stoichiometric oxidizing agent mixture ratio to form reducing flames. In addition, air or oxygen is supplied to the reducing flames in excess of the stoichiometric amount of the oxidizing agent with respect to the fuel gas to create an excess oxygen condition, thereby successively forming oxidizing flames in the combustor. The waste gas is exposed to two different kinds of flames, i.e. reducing flames and oxidizing flames. Thus, a reductive reaction and an oxidative reaction take place successively. In addition, the length of time that the waste gas is in contact with the flames is increased. Therefore, the high-temperature resident time can be lengthened. By the two actions, the waste gas, particularly a halogen gas, can be destroyed completely.

It is preferable that the secondary air injection nozzles inject secondary air into the flame stabilizing zone so as to form swirling flows. However, the secondary air injection nozzles may inject secondary air toward the center so as to cause turbulence between the secondary air and the waste gas after the primary combustion, thereby mixing the secondary air with the waste gas.

An example of the process is as follows:

Gas to be treated: $CF_4$

Premixed gas composition: $H_2+O_2$

Premixed gas mixture ratio: $H_2:O_2=7:3$

Premixed gas flow rate: 50 sl/min

Oxygen supply for oxidizing flames: 10 sl/min

Reductive decomposition reaction in reducing flames:

$CF_4+H_2 \rightarrow CHmFn+HF+F_2$ (m, n is from 0 to 4)

Oxidative decomposition reaction:

$CHmFn+HF+F_2+O_2 \rightarrow CO_2+HF+F_2+H_2O$

After the treatment by this system, the gas is destroyd into $CO_2$ (carbon dioxide), HF (hydrogen fluoride), $F_2$ (fluorine), and $H_2O$ (water).

As has been stated above, a waste gas containing a halogen gas is destroyed by using reducing flames and oxidizing flames formed in a premixing combustor. Thus, destruction treatment can be carried out easily in a small-sized combustor without the need of equipment having a complicated control mechanism. Accordingly, it is possible to achieve a compact and energy-saving system. In addition, because the heat of flames is utilized directly, destruction treatment can be effected with a smaller amount of energy than in a case where a high temperature is produced with electric energy.

It should be noted that the above-described method of destruction-treating an waste gas by reducing and oxidizing flames is applicable not only to the combustor shown in FIGS. 9 and 10 but also to the foregoing combustors shown in FIGS. 1 to 8.

Figure 11:
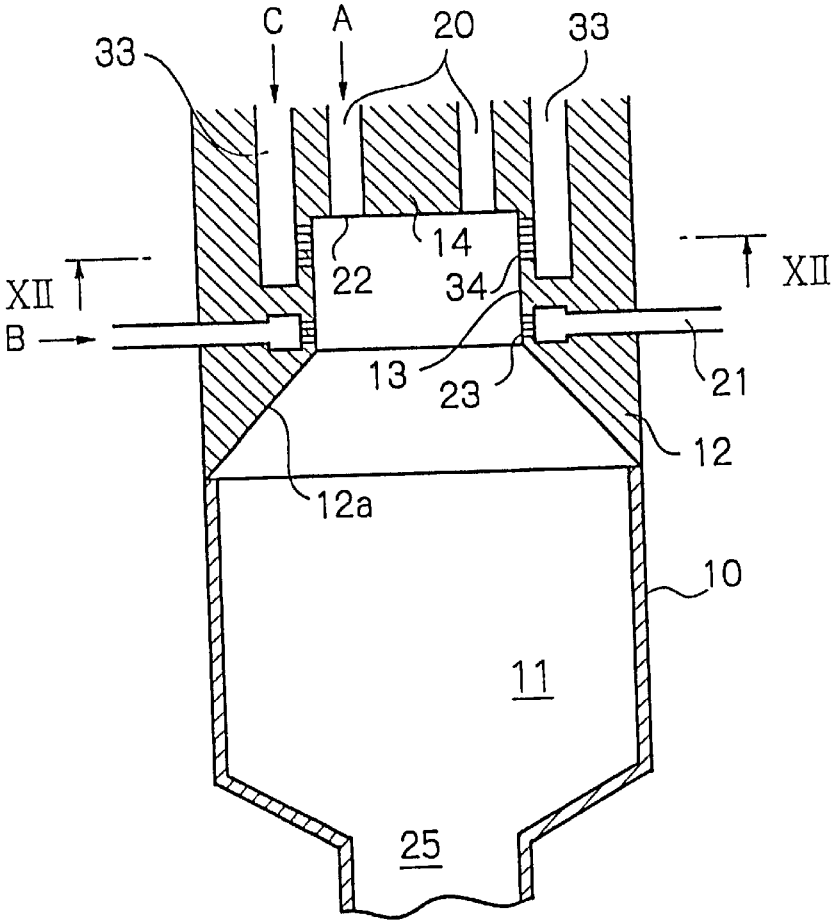
FIG. 11 is a vertical sectional view showing a sixth embodiment of the present invention.
Figure 12:
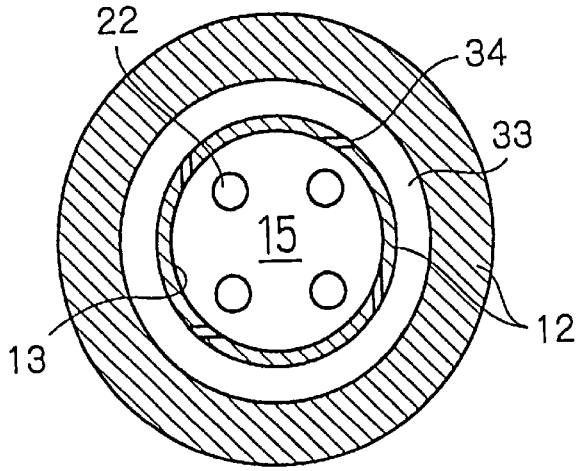
FIG. 12 is a sectional view taken along the line VII—VII in FIG. 11.

FIGS. 11 and 12, show a sixth embodiment of the present invention. A flame stabilizing zone 15 faces a combustion chamber 11 surrounded by a furnace wall 10. The flame stabilizing zone 15 is surrounded with a peripheral wall 13 formed by the inner peripheral surface of a cylindrical member 12. The flame stabilizing zone 15 is closed with a bottom wall 14. The cylindrical member 12 is integrally formed with the bottom wall 14. A plurality (four in the illustrated example) of waste gas chambers 20 are provided in the bottom wall 14 to hold and introduce a waste gas A to be treated, e.g. a waste gas from a semiconductor manufacturing system containing silane ($SiH_4$) gas or the like and consisting mainly of nitrogen. An air chamber 33 and an auxiliary combustible gas chamber 21 are provided in the bottom wall 14 and the cylindrical member 12, which extends from the bottom wall 14, in order from the bottom wall 14 side. The air chamber 33 holds and introduces air C. The auxiliary combustible gas chamber 21 holds and introduces an auxiliary combustible gas B, e.g. a premixed gas of hydrogen and oxygen.

The lower surface of the bottom wall 14 is provided with a plurality of burner ports 22 for waste gas that extend from the respective waste gas chambers 20 and open into the flame stabilizing zone 15. The inner peripheral surface of the cylindrical member 12 near the bottom wall 14 is provided with a plurality of air injection nozzles 34 that provide communication between the air chamber 33 and the flame stabilizing zone 15. In addition, the inner peripheral surface of the cylindrical member 12 near the outlet of the flame stabilizing zone 15, which is away from the bottom wall 14, is provided with a plurality of burner ports 23 for auxiliary combustible gas that provide communication between the auxiliary combustible gas chamber 21 and the flame stabilizing zone 15. The burner ports 23 for auxiliary combustible gas and the air injection nozzles 34 extend approximately tangentially to the flame stabilizing zone 15 to inject the auxiliary combustible gas B and the air C, respectively, into the flame stabilizing zone 15 so as to form swirling flows in the same direction. Further, a conical surface **12*a* extends from the peripheral wall 13 of the cylindrical member 12 to the side surface of the combustion chamber 11 to constitute a part of the combustion chamber 11. A combustion gas outlet 25 is integrally connected to the lower end of the combustion chamber 11**.

Next, the operation of the combustor for waste gas treatment according to this embodiment will be described. First, the auxiliary combustible gas B is introduced into the auxiliary combustible gas chamber 21 and held therein and is then injected from the burner ports 23 for auxiliary combustible gas, which are provided in the inner peripheral surface of the cylindrical member 12, into the flame stabilizing zone 15 so as to produce swirling flows. When ignited by an ignition source (not shown), the auxiliary combustible gas B forms swirling flames along the inner peripheral surface of the cylindrical member 12. Swirling flames have the feature that they can burn stably over a wide range of equivalence ratios. In other words, because the flames swirl strongly, they supply heat and radicals to each other. Thus, flame stabilizing properties are improved. Even at such a small equivalence ratio that unburned gas may be discharged or quenching may occur in the conventional system, the auxiliary combustible gas B can burn stably without generating unburnt gas and without causing oscillating combustion even in the vicinity of the equivalence ratio of 1. Meanwhile, the waste gas A to be treated, which is introduced and held in the waste gas chambers 20, is injected into the flame stabilizing zone 15 from the burner ports 22 for waste gas, which open on the lower surface of the bottom wall 14. Consequently, the waste gas A mixes with the swirling flames of the auxiliary combustible gas B and burns. At this time, because the auxiliary combustible gas B is injected so as to swirl strongly in one direction, all the waste gas A mixes satisfactorily with the flames. Thus, the efficiency of the combustive destruction of the waste gas becomes very high.

Air that is injected into the flame stabilizing zone from the air injection nozzles 34 acts as follows. Research carried out by the present inventors reveals that swirling flames overheat the cylindrical member 12 and the auxiliary combustible gas B in the auxiliary combustible gas chamber 21. That is, it is necessary in order to continue stable combustion to effect cooling so that the temperature will not exceed the heat resistance of the constituent material of the cylindrical member 12. In addition, if the auxiliary combustible gas B is overheated in excess of the ignition temperature thereof, it may initiate combustion in the auxiliary combustible gas chamber 21 when an oxidizing agent is contained in the auxiliary combustible gas. Therefore, it is necessary to effect cooling so that the temperature will not exceed the ignition temperature of the auxiliary combustible gas B. For this reason, air injected into the combustion chamber 11 from the air injection nozzles 34, which are provided upstream of the burner ports 23 for auxiliary combustible gas, swirls in the flame stabilizing zone 15 to cool the peripheral wall 13. The air also cools the auxiliary combustible gas B through cooling of the peripheral wall 13. Thus, the air acts so as to continue stable combustion. Furthermore, flames from the burner ports 23 for auxiliary combustible gas are swirling, and the air injected from the air injection nozzles 34 is also swirling. Therefore, as it mixes with the flames, the air flow further accelerates the swirling flows of the flames to form strong swirling flows. When swirling flames are formed, the pressure of the gas flow in the center of the swirl reduces. Consequently, self-circulating flows that flow backward from the forward ends of the flames toward the burner ports 22 for waste gas and the burner ports 23 for auxiliary combustible gas occur in the center of the swirl. The circulating flows mix with the flames from the burner ports and the combustion gas, thereby suppressing the formation of $NO_x$.

The flames from the burner ports 23 for auxiliary combustible gas are swirling strongly, and the swirling flows prevent silica ($SiO_2$), which results from the combustion of silane gas or the like, from adhering to the burner ports 22 for waste gas or the burner ports 23 for auxiliary combustible gas. More specifically, when silane ($SiH_4$) or the like burns, powdery silica ($SiO_2$) is formed. If the silica ($SiO_2$) adheres to the vicinities of the burner ports 22 for waste gas and the burner ports 23 for auxiliary combustible gas, it may reduce the amounts of auxiliary combustible gas B and waste gas A being injected or change the directions of these gases being injected, causing the injecting of the gases to be unstable. Under such circumstances, the injecting of the gases is not stabilized, and it becomes impossible to perform stable combustion. In this embodiment, swirling flames from the burner ports 23 for auxiliary combustible gas cause fast flows to occur at the distal ends of the burner ports 22 for waste gas and the burner ports 23 for auxiliary combustible gas. The fast flows act so as to clean the distal end portions of the burner ports 22 and 23, thereby preventing the resulting powdery silica ($SiO_2$) from adhering to the distal end portions of the burner ports 22 and 23. This effect becomes even more remarkable because of the presence of the swirling air flows from the air injection nozzles 34.

The cleaning effect is not confined to the distal end portions of the burner ports 22 and 23. That is, because the flames swirl in the combustion chamber 11, fast flows also occur along the wall surface of the combustion chamber 11. The fast flows clean the wall surface of the combustion chamber 11, thereby removing silica ($SiO_2$) from the wall surface. Thus, silica ($SiO_2$) attached to the surfaces of the burner ports 22 and 23 and the wall surface of the combustion chamber 11 is removed in self-cleaning manner by the swirling flows.

In addition, a premixed gas containing an oxidizing agent is used as an auxiliary combustible gas to be supplied, and the mixture ratio of the oxidizing agent to the fuel gas in the premixed gas is made lower than the stoichiometric oxidizing agent mixture ratio to form an over-rich premixed gas that is over-rich in fuel. The premixed gas is injected to swirl from the burner ports 23, thereby forming primary swirling reducing flames in the flame stabilizing zone. The reducing flames and the waste gas A from the nozzles 22 are brought into contact with each other to reductively destroy the waste gas, particularly an waste gas containing a halogen gas. Next, oxygen is sufficiently given to the reducing flames in excess of the stoichiometric amount from the injected from the upstream air injection nozzles 34 to create an excess oxygen condition, thereby forming secondary oxidizing flames. Oxidative destruction of the waste gas is effected by the oxidizing flames. The waste gas is exposed to flames in two stages, i.e. reducing flames and oxidizing flames. Thus, the length of time that the waste gas is in contact with the flames is increased. Consequently, the high-temperature resident or stay time can be lengthened. A waste gas containing a halogen gas has the property that it can be destroyed if the atmosphere temperature is high and the high-temperature state is maintained for a long period of time. Thus, the waste gas is exposed to different flames in two stages, i.e. reducing and oxidizing flames, and the high-temperature state created by the flames is maintained for an extended period of time. By doing so, the waste gas, particularly a halogen gas, can be destroyed completely.

Figure 13:
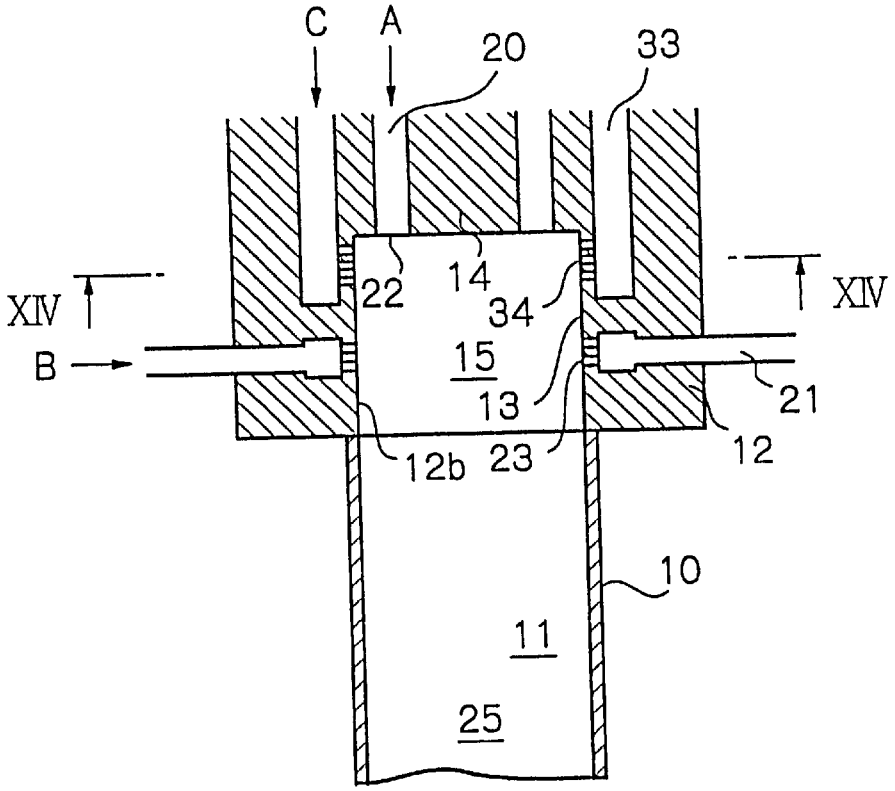
FIG. 13 is a vertical sectional view showing a seventh embodiment of the present invention.
Figure 14:
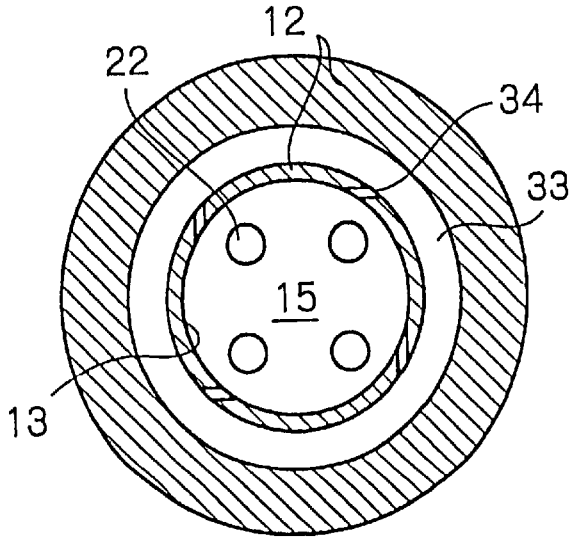
FIG. 14 is a sectional view taken along the line XIV—XIV in FIG. 13.

FIGS. 13 and 14 show a seventh embodiment of the present invention. This is a modification of the sixth embodiment in which the inner diameter of the cylindrical member 12 and the inner diameter of the combustion chamber 11 are set approximately the same. In this embodiment, the conical surface in the sixth embodiment that connects the peripheral wall 13 of the cylindrical member 12 and the side surface of the combustion chamber 11 is formed so as to be a simple cylindrical surface 12*b*. With this arrangement, the swirl diameter of the swirling flows is kept approximately the same all the way to the outlet. Accordingly, favorable swirling flows can be maintained from the flame stabilizing zone to the outlet of the combustion chamber, and a stagnant flow region can be eliminated. Thus, the amount of powdery silica ($SiO_2$) adhering to the wall surface can be reduced to a considerable extent.

Figure 15:
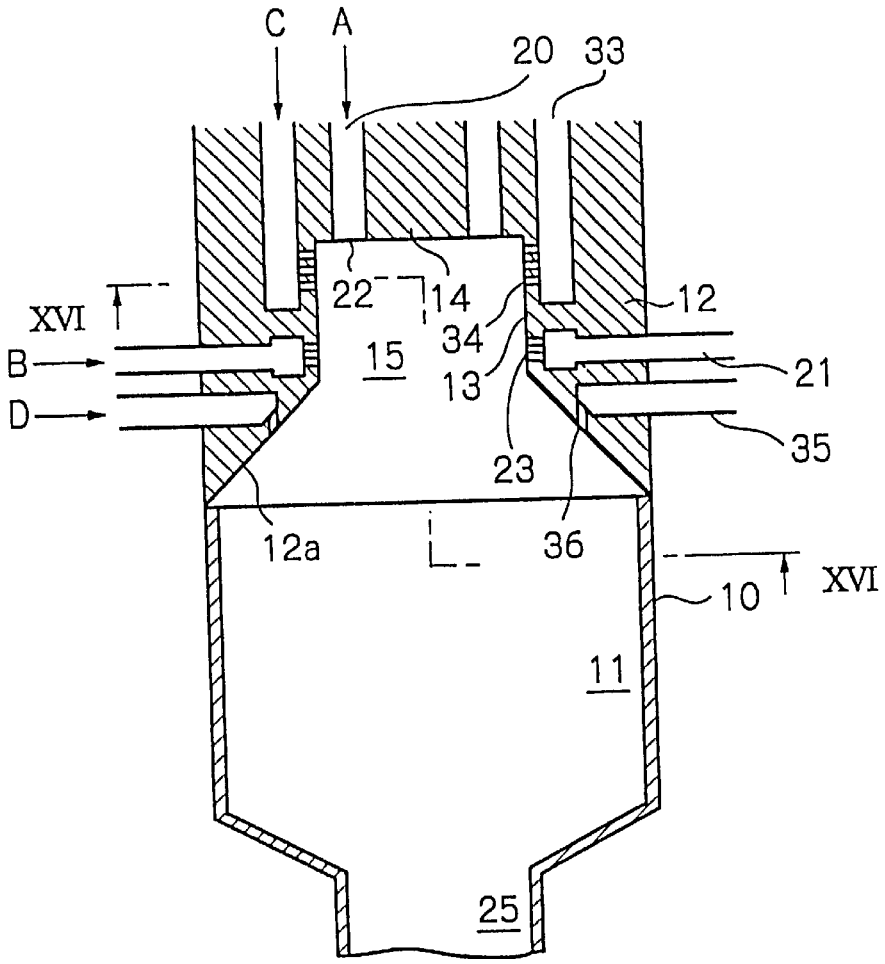
FIG. 15 is a vertical sectional view showing an eighth embodiment of the present invention.
Figure 16:
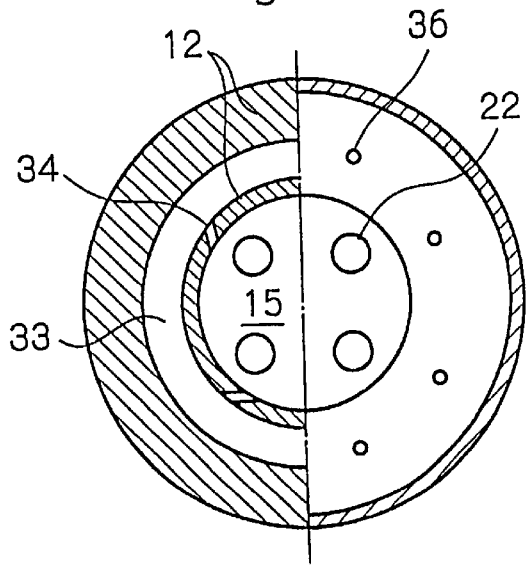
FIG. 16 is a sectional view taken along the line XVI—XVI in FIG. 15.

FIGS. 15 and 16 show an eighth embodiment of the present invention. An air chamber 35 for holding and introducing secondary combustion air D is provided within a conical surface 12*a* that extends from the peripheral wall 13 zone, and thus the high-temperature region is enlarged downward. Accordingly, the high-temperature resident resident time of the waste gas can be further lengthened. Thus, the waste gas is exposed to different flames in two stages, i.e. reducing flames and oxidizing flames. Moreover, the high temperature state created by the flames is maintained for an extended period of time. By doing so, the waste gas, particularly a halogen gas, can be destroyed completely. In this case, air is also injected from the secondary combustion air injection nozzles 36 to form secondary flames. It is preferable that the secondary combustion air injection nozzles inject secondary air toward the flame stabilizing zone so as to form swirling flows. However, the secondary combustion air injection nozzles may face downward as in this embodiment. The arrangement may also be such that the secondary combustion air injection nozzles inject secondary air toward the center of the combustor so as to cause turbulence between the secondary air and the waste gas after the primary combustion by the reducing flames, thereby mixing the secondary air with the waste gas.

Figure 17:
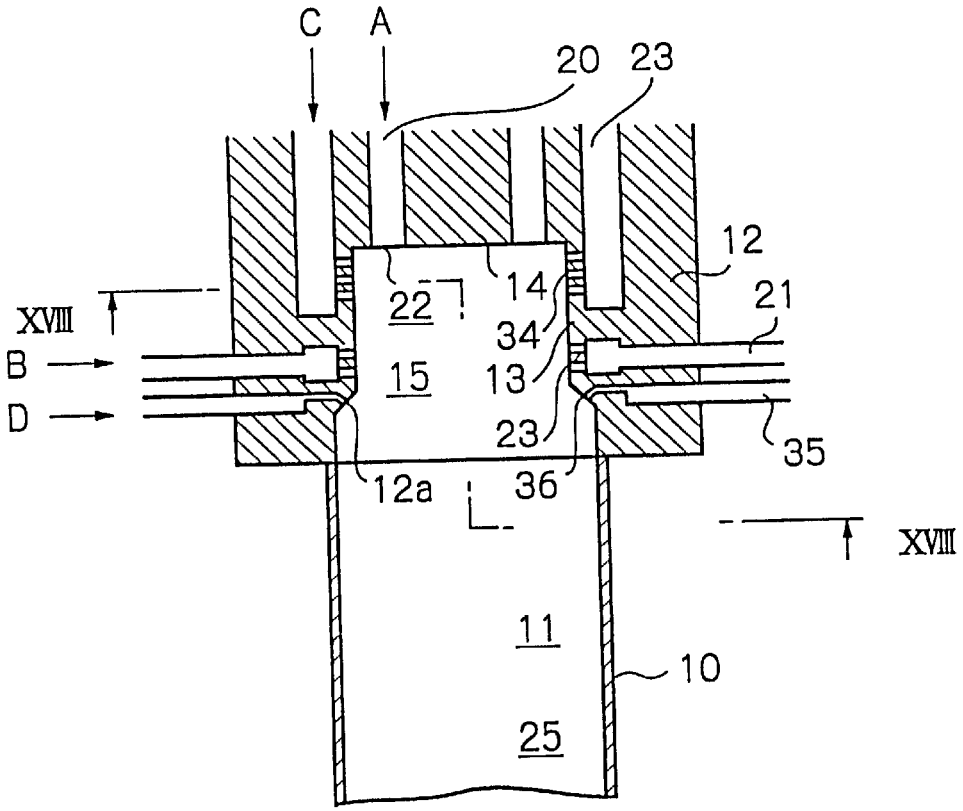
FIG. 17 is a vertical sectional view showing a ninth embodiment of the present invention.
Figure 18:
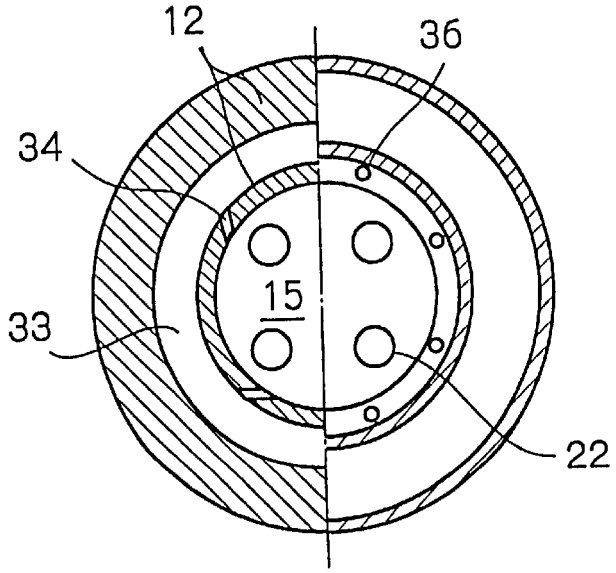
FIG. 18 is a sectional view taken along the line XVIII—XVIII in FIG. 17.

FIGS. 17 and 18 show a ninth embodiment of the present invention. This is a modification of the eighth embodiment in which thee inner diameter of the cylindrical member 12 and the inner diameter of the combustion chamber 11 are set approximately the same. To be precise, the inner diameter of the combustion chamber 11 is set slightly larger than the inner diameter of the cylindrical member 12.

Figure 19:
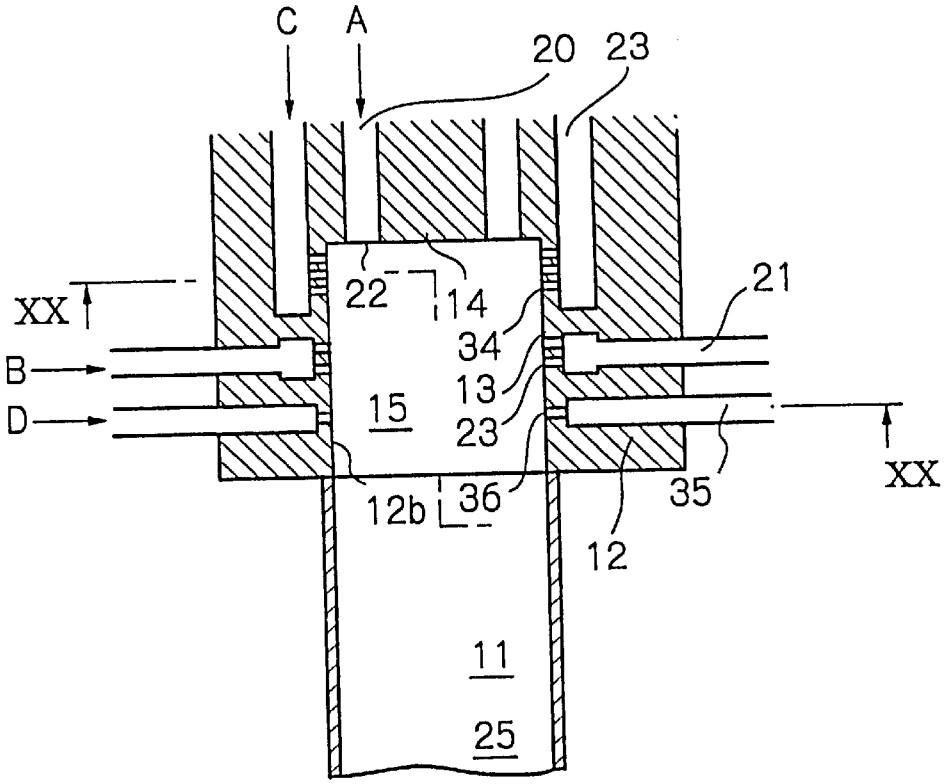
FIG. 19 is a vertical sectional view showing a tenth embodiment of the present invention.
Figure 20:
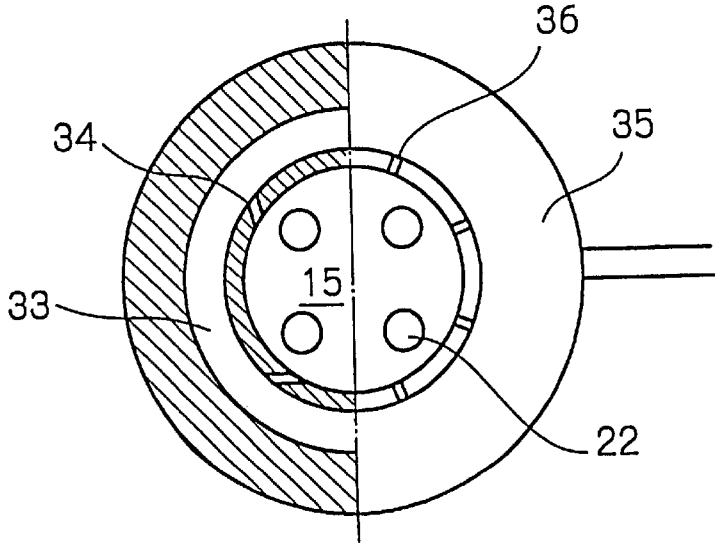
FIG. 20 is a sectional view taken along the line XX—XX in FIG. 19.

FIGS. 19 and 20 show a tenth embodiment of the present invention. This is a modification of the ninth embodiment in which the inner diameter of the cylindrical member 12 and the inner diameter of the combustion chamber 11 are set identical with each other, and not a conical surface but a cylindrical surface 12*b* connects the peripheral wall of the cylindrical member and the side surface of the combustion chamber as in the seventh embodiment. In this case, the secondary combustion air injection nozzles 36 are provided to extend from the air chamber 35 and to open on the cylindrical surface 12*b* toward the combustion chamber 11.

Figure 21:
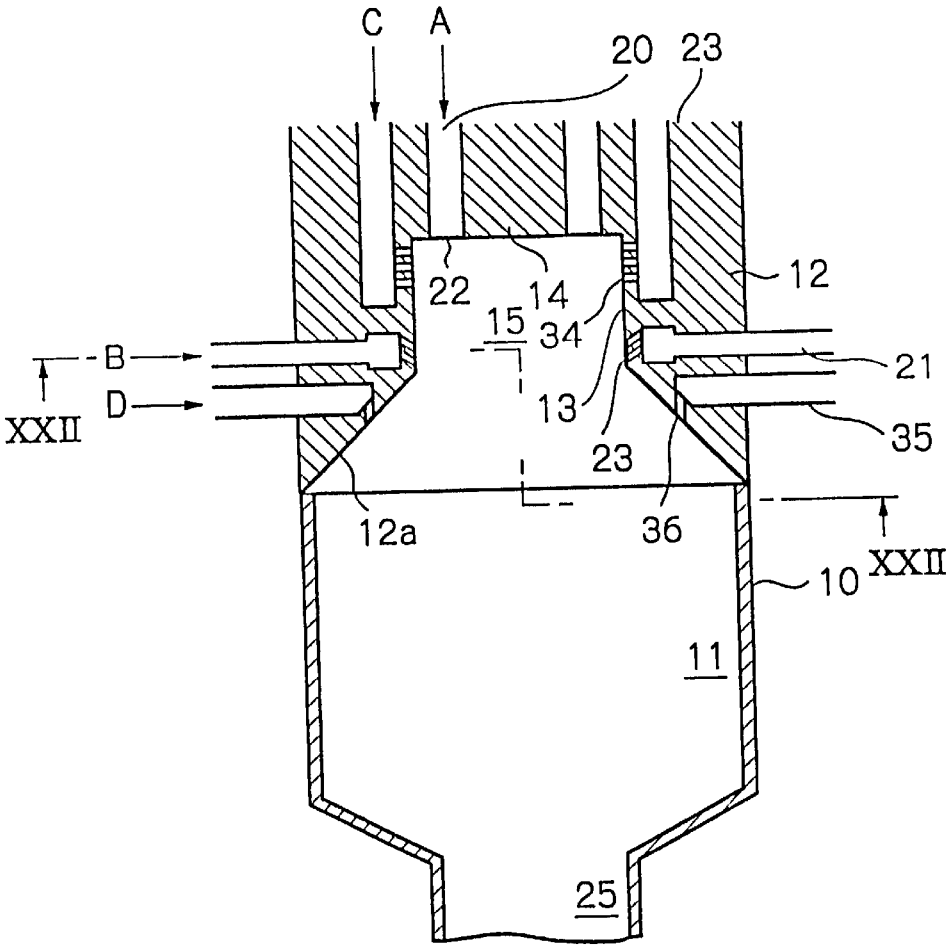
FIG. 21 is a vertical sectional view showing an eleventh embodiment of the present invention.
Figure 22:
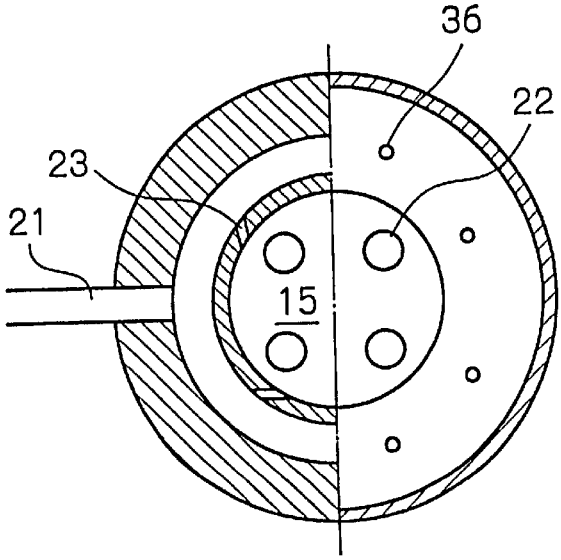
FIG. 22 is a sectional view taken along the line XXII—XXII in FIG. 21.
Figure 23:
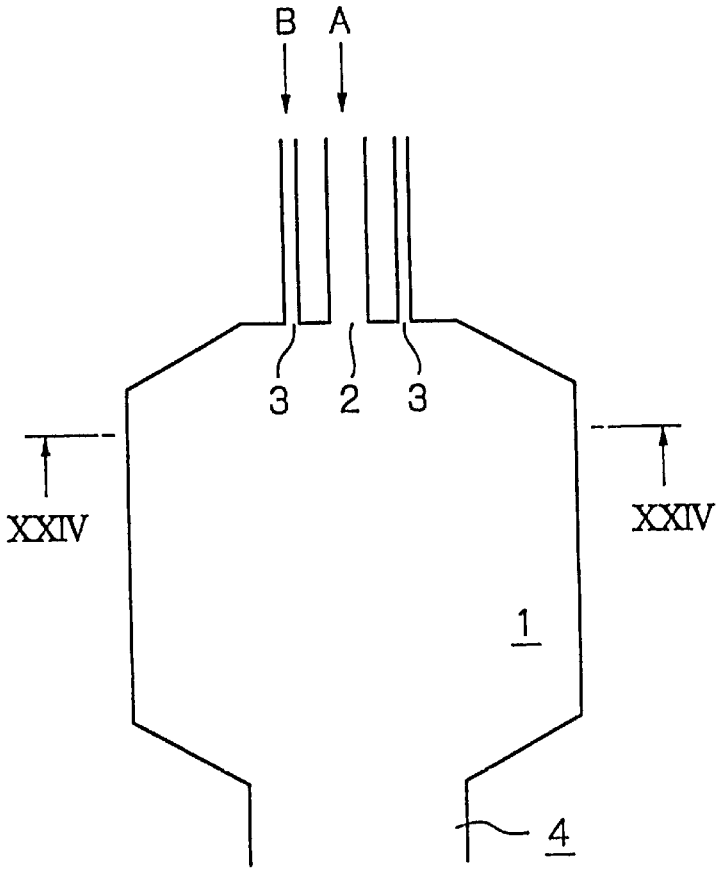
Fig.23 PRIOR ART
FIG. 23 is a vertical sectional view showing a conventional example.
Figure 24:
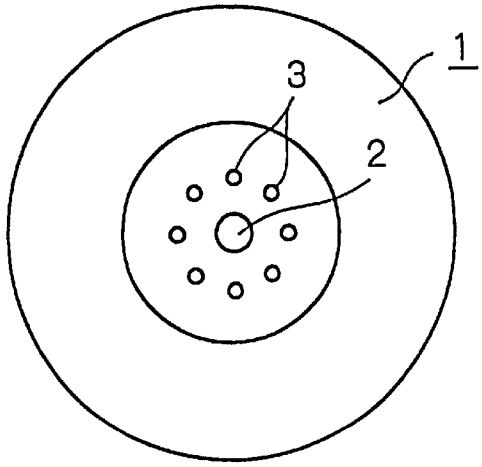
Fig.24 PRIOR ART
FIG. 24 is a sectional view taken along the line XXIV—XXIV in FIG. 23.

FIGS. 21 and 22 show an eleventh embodiment of the present invention. This is a modification of the eighth embodiment in which the burner ports 23 for auxiliary combustible gas face obliquely downward toward the downstream side of the flame stabilizing zone 15 to inject the auxiliary combustible gas B so as to form swirling flows. Thus, flames injected from the burner ports 23 for auxiliary combustible gas form spiral swirling flows toward the downstream side of the flame stabilizing zone. Accordingly, the length of swirl when the swirling flames flow along the peripheral wall of the cylindrical member 12 is shorter than in a case where the auxiliary combustible gas is injected horizontally as in the eighth embodiment. Consequently, an area where the flames heat the peripheral wall of the cylindrical member narrows. Thus, heating of the peripheral wall by the swirling flows and the rise in temperature are suppressed. This allows the heat resistant life of the cylindrical member constituent material to be extended. In addition, it is possible to reduce the amount of cooling air supplied from the air injection nozzles 34 and hence possible to suppress the lowering of flame temperature by cooling and to maintain the high-temperature state favorably. Accordingly, the efficiency of destruction of an waste gas containing a halogen gas can be increased. It should be noted that the arrangement of this embodiment in which the burner ports for auxiliary combustible gas face obliquely toward the downstream side to inject the auxiliary combustible gas so as to form swirling flows may be applied to the first to tenth embodiments.

It should be noted that in each of the foregoing embodiments a ceramic or heat-resistant metal material is suitable for use as a material for forming the combustor. Although an example in which flames is injected downward is shown, the present invention may also be applied to an arrangement in which flames is injected horizontally. The auxiliary combustible gas is not necessarily limited to a premixed gas of hydrogen and oxygen but may be a fuel gas, e.g. hydrogen, city gas or LPG, or a premixed gas prepared by mixing together city gas or LPG and oxygen, air or oxygen enrichment air.

Although in each of the foregoing embodiments the present invention is applied to a cylindrical combustor, it should be noted that the present invention is not necessarily limited thereto but may also be applied to a polygonal combustor, e.g. a quadrangular combustor.

EFFECT OF THE INVENTION

As has been stated above, according to the first aspect of the present invention, an auxiliary combustible gas is injected into a flame stabilizing zone so as to produce swirling flows flowing in one direction, thereby efficiently mixing the flame of the auxiliary combustible gas with an waste gas to be treated, and thus allowing the waste gas to be destroyed through combustion with high efficiency. Moreover, because swirling flames are formed to burn the waste gas, silica ($SiO_2$) resulting from the combustion of silane is prevented from adhering to the vicinities of the burner ports, thereby stably treating the waste gas through combustion. Moreover, silica ($SiO_2$) adhered to the wall surface of the combustion chamber can be removed by the swirling flows.

By using a premixed gas as an auxiliary combustible gas and performing premixed combustion, low-$NO_x$ combustion can be accomplished at a low equivalence ratio.

Further, by providing air injection nozzles so that air injected from the injection nozzles forms swirling flows in the combustion chamber, silica ($SiO_2$) adhered to the wall of the combustion chamber can be removed even more effectively. Accordingly, it is possible to extend the maintenance interval for cleaning.

By providing the bottom wall with a primary air injection nozzle for injecting primary air into the flame stabilizing zone, combustibility is improved. In addition, silica ($SiO_2$) adhered to the surfaces of the inner and outer walls defining the flame stabilizing zone can be removed even more effectively.

By setting the inner diameter of the combustion chamber and the inner diameter of the peripheral wall of the flame stabilizing zone approximately the same, a stagnant flow region is eliminated, and it is possible to prevent powdery silica ($SiO_2$) from adhering to the inner wall of the flame stabilizing zone or the combustion chamber even more effectively.

By forming reducing flames and oxidizing flames and passing the waste gas from the inside thereof, the waste gas can be first reductively destroyed and then oxidatively destroyed. Thus, a harmful waste gas can be made harmless with a relatively small-sized system without the need to consume a huge amount of energy.

According to another aspect of the present invention, air injection nozzles are provided in the peripheral wall of the flame stabilizing zone near the bottom wall so that air injected from the air injection nozzles forms swirling flows in the flame stabilizing zone. With this arrangement, the cylindrical member and the auxiliary combustible gas in the auxiliary combustible gas chamber is cooled. Thus, it is possible to continue stable combustion in addition to the above-described advantageous effects. Moreover, the swirling flows of flames are accelerated, so that it is possible to prevent silica ($SiO_2$) resulting from the combustion of silane from adhering to the vicinities of the burner ports and to continue stable combustion. In addition, silica ($SiO_2$) adhered to the peripheral wall of the cylindrical member and the wall of the combustion chamber is removed even more effectively. Accordingly, it is possible to extend the maintenance interval for cleaning.

Further, by providing secondary combustion air injection nozzles near the lower end of the flame stabilizing zone or at the downstream side thereof, secondary flames are formed downstream of the flame stabilizing zone. Accordingly, it is possible to enlarge the high-temperature resident area and hence possible to increase the efficiency of destruction of a halogen gas.

Further, by arranging burner ports for auxiliary combustible gas to face obliquely downstream of the flame stabilizing zone so as to inject the auxiliary combustible gas spirally, it is possible to suppress heating of the cylindrical member and the rise in temperature and hence possible to extend the heat resistant life. In addition, it is possible to reduce the amount of cooling air supplied from the air injection nozzles and to increase the efficiency of destruction of an waste gas containing a halogen gas.

What is claimed is:

1. A combustor for waste gas treatment, said combustor comprising:

a combustion chamber;

a peripheral wall closed on one end by a bottom wall, thereby forming a flame stabilizing zone, the flame stabilizing zone opening into said combustion chamber;

an air injection nozzle provided in said peripheral wall of the flame stabilizing zone;

a burner port for auxiliary combustible gas provided in said peripheral wall, said burner port for auxiliary combustible gas being operable to inject an auxiliary combustible gas into the flame stabilizing zone so as to produce a swirling flame flow; and a plurality of burner ports for waste gas provided in said bottom wall along a periphery thereof, said plurality of burner ports for waste gas being operable to inject a waste gas into the swirling flame flow formed in the flame stabilizing zone, wherein an inner diameter of each of said plurality of burner ports for waste gas is smaller than a diameter of the flame stabilizing zone, wherein the auxiliary combustible gas is a premixed gas.

2. A combustor according to claim 1, wherein said peripheral wall is formed by an inner peripheral surface of a cylindrical member.

3. A combustor for waste gas treatment, said combustor comprising:

a combustion chamber;

a peripheral wall closed on one end by a bottom wall, thereby forming a flame stabilizing zone, the flame stabilizing zone opening into said combustion chamber;

a burner port for waste gas provided in said bottom wall, said burner port for waste gas being operable to inject a waste gas into the flame stabilizing zone;

an air injection nozzle provided in said peripheral wall of the flame stabilizing zone near said bottom wall, said air injection nozzle being operable to inject air into the flame stabilizing zone so as to produce a swirling flow, and a burner port for auxiliary combustible gas provided in said peripheral wall of the flame stabilizing zone away from said bottom wall, said burner port for auxiliary combustible gas being operable to inject an auxiliary combustible gas into the flame stabilizing zone so as to produce a swirling flow.

4. The combustor according to claim 3, wherein the auxiliary combustible gas is an over-rich premixed gas containing a fuel gas in excess of a stoichiometric amount.

5. The combustor according to claim 3, wherein an inner diameter of said combustion chamber and an inner diameter of said peripheral wall of the flame stabilizing zone are approximately identical to each other.

6. The combustor according to claim 3, wherein either said combustion chamber comprises a wall surface extending from said peripheral wall of the flame stabilizing zone, said wall surface having a secondary combustion air injection nozzle or said peripheral wall surface has said secondary combustion air injection nozzle near a lower end of the flame stabilizing zone.

7. The combustor according to claim 3, wherein said burner port for auxiliary combustible gas is provided in said peripheral wall faces obliquely toward a downstream side.

8. The combustor according to claim 3, wherein the auxiliary combustible gas is either a fuel gas, or a premixed gas.

* * * * *